United States Patent [19]

Granlund

[11] Patent Number: 4,999,949

[45] Date of Patent: Mar. 19, 1991

[54] DEVICE FOR CONVENTIONAL WOODEN DOORS

[76] Inventor: Bertil Granlund, Varmlandsvagen 30, S-691 34 Karlskoga, Sweden

[21] Appl. No.: 427,952

[22] Filed: Oct. 25, 1989

Related U.S. Application Data

[63] Continuation of Ser. No. 207,157, Jun. 15, 1988, abandoned.

[51] Int. Cl.[5] ..... E06B 7/16

[52] U.S. Cl. ..... 49/383; 49/395; 49/503

[58] Field of Search ..... 49/394, 395, 383, 503, 49/54; 292/38, 171

[56] References Cited

U.S. PATENT DOCUMENTS

| | | | |
|---|---|---|---|
| 2,772,905 | 12/1956 | Dusing | 49/503 |
| 4,146,994 | 5/1979 | Williams | 49/395 |
| 4,435,921 | 3/1984 | Marin | 49/395 |

FOREIGN PATENT DOCUMENTS

| | | |
|---|---|---|
| 0085038 | 8/1983 | European Pat. Off. . |
| 2529778 | 3/1977 | Fed. Rep. of Germany . |
| 2639691 | 4/1980 | Fed. Rep. of Germany . |
| 3146746 | 8/1982 | Fed. Rep. of Germany . |
| 2442331 | 11/1978 | France . |
| 2413857 | 7/1979 | France . |
| 24548721 | 1/1985 | France . |
| 2567190 | 1/1986 | France . |
| 2127078 | 4/1984 | United Kingdom . |

*Primary Examiner*—Kenneth J. Dorner
*Assistant Examiner*—Gerald A. Anderson
*Attorney, Agent, or Firm*—Dennison, Meserole, Pollack & Scheiner

[57] ABSTRACT

A conventional wooden door (1) is generally provided with a handle (29) activating a latch from closed to open position and a latch knob (30) activating a bolt between closed and open position. The latch and bolt enter recesses provided in the frame flange (15) and for this reason it is relatively easy to break open a door (1). This is made more difficult if a body (2) is arranged on the inside of the door, said body (2) being provided with spring bolts (17 and 18) and dowels (23 and 24) to fit into recesses (19, 20) in the relevant jambs (16, 11, respectively).

4 Claims, 1 Drawing Sheet

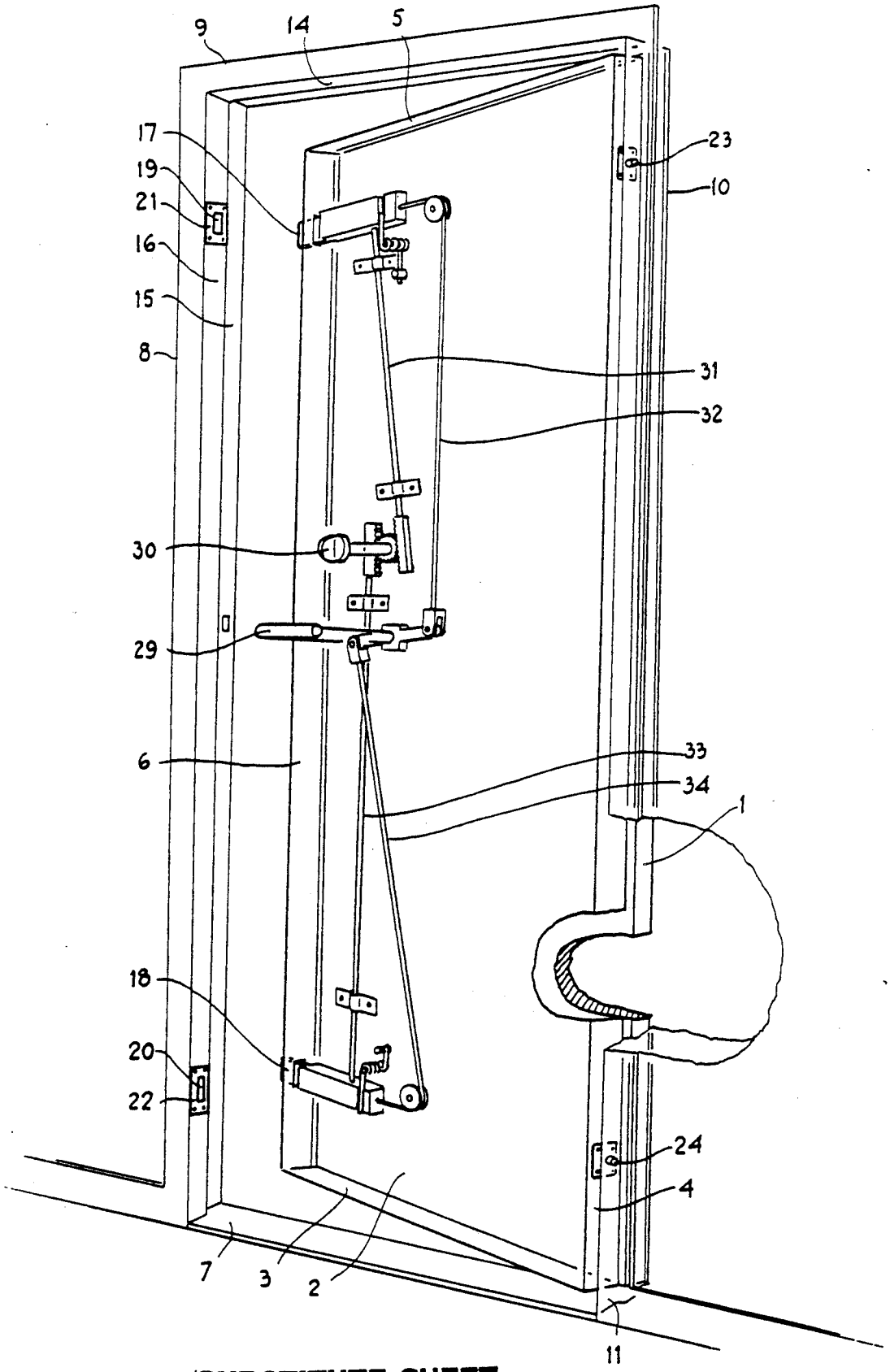
SUBSTITUTE SHEET

DEVICE FOR CONVENTIONAL WOODEN DOORS

This is a continuation of copending application(s) Ser. Nos. 07/207,157 filed on June 15, 1988, now abandoned. "International Application PCT/SE No. 86/00379 filed on August 26, 1986 and which designated the U.S."

BACKGROUND OF THE INVENTION

The present invention relates preferably to doors made of wood and used as entrance doors and as apartment frontdoors. In such doors striking plates are used beside the bolts to prevent a locked door from being broken up. On the hinge side of the dowels are generally used which may be located in the door itself or in the opposite frame part. The purpose of these dowels is also to make breaking-in more difficult. Despite these deterrents it is still possible to destroy a locked door, enabling illicit entry. In order to make this more difficult, doors have been made entirely of sheet metal and such doors certainly prevent undesired entry through the doorway. However, a metal door is considerably more expensive than a wooden door and it is thus not always feasible to replace a wooden door by a metal one.

SUMMARY OF THE INVENTION

The object of the present invention is to make illicit entry through a doorway closed by a wooden door considerably more difficult. According to the invention, this is achieved by providing the inside of the door with a parallelepiped or rectangular body, consisting of one or more parts and being made of a hard material such as metal. The body closely fits the jambs and lintel of the surrounding doorframe. The body contains one or more spring bolts cooperating with one of the jambs of the doorframe. Said spring bolts are displaced by members controlled by the handle and possibly also latch knob of the original door.

The body is provided with dowels on the side opposite the one containing the spring bolts. Said dowels are intended to cooperate with the other jamb of the doorframe.

Additional features of the invention are revealed in the following claims.

BRIEF DESCRIPTION OF THE DRAWINGS

The drawing shows a door hanging in a door frame with the device having a parallel-piped body and a number of parts of the invention.

The present invention will be described in more detail with reference to the accompanying drawing showing a door hung in a doorframe.

DESCRIPTION OF THE PREFERRED EMBODIMENT

The FIGURE shows a conventional wooden door 1 hung in a frame 8–10. A threshold 7 cooperates with the doorframe. The original door is provided with a handle 29 and a latch knob 30. A body 2 has been secured on the inside of the door. This is manufactured from cold-rolled sheet metal having a thickness in the order of 1.25 mm. The body is constructed from a sheet of metal shaped with an upper surface, two side surfaces and two flange surfaces terminating each side surface, said flange surfaces being parallel to the upper part. The upper and lower side surfaces of the body are completely open. However, they may of course be closed by bending the sheet metal. The inner surface of the body may be made larger than said flange surfaces so as to correspond exactly to the upper side of the body or to such an extent that the region around the handle and latch knob is covered by metal. When the door 2 is closed, the side surfaces of the body fit closely to the jambs and lintel 11, 16 and 14 of the doorframe 8–10 and to the threshold 7 or floor surface replacing the threshold. The body 2 is secured to the door 1 by suitable means such as screws. The cavity in the body is suitably filled with a material which is fire-proof and possibly also sound-proof. The shafts of the handle 29 and latch knob 30 are extended to allow them to be operated from the inside of the body 2. The parallel-epipedic body contains two spring bolts 17 and 18 cooperating with recesses 19 and 20 in the jamb 16 of the vertical frame part 8. Each hole or recess is surrounded by a striking plate 21, 22, respectively. The two spring bolts 17 and 18 are controlled by the handle 29 and latch knob 30 via movement-transmitting members 31–34. The side of the body opposite the side with the spring bolts is provided with two dowels 23 and 24, each cooperating with recesses, not shown, in the jamb 11 of the doorframe 8. Each of the recesses is surrounded by a striking plate, not shown.

Since the spring bolts and dowels of the parallel-epipedic body 2 cooperate with the jambs of the doorframe, it is more difficult to break up a door provided with a body in accordance with the present invention. The body also impedes undesired operation of the spring bolts.

The present invention enables conventional front doors to be made more difficult to break into without the door having to be replaced by a door made entirely of metal.

The body may be made of several vertical units to facilitate repairs on the lock. In this case, the part located furthest from the hinge shall contain said spring bolts 17 and 18 and said movement-transmitting members 31–34.

The movement-transmitting members may consist of link systems or of wire systems or of a combination of both.

The movement-transmitting members may be arranged together with the spring bolts as a unit in a door, the bolts cooperating with the thickest part of a vertical frame part, i.e. one of the jambs. The door can then be made either as single unit or as a door provided with a protective body.

I claim:

1. A system of reinforcement for a conventional door mounted within a door frame including two opposed vertical jambs, said door being hinge-hung on one vertical jamb for selective opening and closing, said conventional door including latch means selectively engaging the second vertical jamb upon a closing of the door, said door including inner and outer faces, and said latch means including manipulable handle means extending from said inner face of said conventional door; said system including a separately mountable reinforcing body positioned substantially coextensive with and covering the entire exposed inner face of the door within the jambs, said body including a face panel coextensive with said inner door face and having edge flanges closely adjacent said jambs of said door frame upon closing of the door and spacing said body face panel from said inner door face to define a hollow interior, means for fixing the positioned reinforcing body to said door inner face, latch bolt means mounted within said hollow interior for selective extension beyond said reinforcing body and into said second vertical jamb upon a closing of said door, said second vertical jamb including recessed keeper means for receiving said latch bolt means, and means for engaging said manipulable handle means of said conventional door with the latch bolt means within the hollow interior and for controlling the selective extension of said latch bolt means beyond said reinforcing body and into said recessed keeper means and to selectively manipulate both said latch bolt means of said body and said latch means of said conventional door, said means for engaging said manipulable handle means with the latch bolt means extending beyond said reinforcing body face panel for manual access thereto.

2. The reinforcement system of claim 1 including recessed keeper means in said one vertical jamb, and dowel means on said reinforcing body selectively engageable in the keeper means in said one second vertical jamb upon a closing of said door.

3. The reinforcement system of claim 2 wherein said reinforcing body is formed of metal.

4. The reinforcement system of claim 2 including insulation within said hollow interior.

* * * * *